US008001987B2

(12) United States Patent
Williams

(10) Patent No.: US 8,001,987 B2
(45) Date of Patent: Aug. 23, 2011

(54) SUPPORT SYSTEM FOR SHELTERS

(75) Inventor: Marty Williams, Colorado Springs, CO (US)

(73) Assignee: Let's Go Aero, Inc., Colorado Springs, CO (US)

( * ) Notice: Subject to any disclaimer, the term of this patent is extended or adjusted under 35 U.S.C. 154(b) by 679 days.

(21) Appl. No.: 11/164,732

(22) Filed: Dec. 2, 2005

(65) Prior Publication Data

US 2007/0125410 A1 Jun. 7, 2007

(51) Int. Cl.
*E04H 15/32* (2006.01)

(52) U.S. Cl. ..... 135/136; 135/125; 135/151; 135/158; 52/63; 52/83

(58) Field of Classification Search ..... 135/124–126, 135/128, 136–138, 151, 156, 158, 906, 133, 135/97; 52/79.4–79.5, 82–83, 63, 80.1, 81.1; 472/62, 136; 446/476, 478
See application file for complete search history.

(56) References Cited

U.S. PATENT DOCUMENTS

| | | | | |
|---|---|---|---|---|
| 3,130,739 | A | 4/1964 | Kohorn | 135/5 |
| 3,625,235 | A | 12/1971 | Gorgichuk | 135/1 |
| 3,751,862 | A * | 8/1973 | Linecker | 52/2.18 |
| 4,569,362 | A | 2/1986 | Fidler, Jr. | 135/104 |
| 4,716,919 | A * | 1/1988 | Griffin | 135/133 |
| 5,137,044 | A | 8/1992 | Brady | 135/104 |
| 5,159,948 | A * | 11/1992 | Moreau et al. | 135/125 |
| 5,301,706 | A | 4/1994 | Jones | 135/104 |
| 5,441,069 | A * | 8/1995 | Moss | 135/124 |
| 5,618,246 | A * | 4/1997 | Zheng | 482/35 |
| 5,628,336 | A * | 5/1997 | Lee | 135/114 |
| 6,260,306 | B1 * | 7/2001 | Swetish et al. | 52/2.18 |
| 6,263,617 | B1 * | 7/2001 | Turcot et al. | 52/2.18 |
| 6,305,396 | B1 * | 10/2001 | Zheng | 135/126 |
| 6,325,086 | B1 * | 12/2001 | Shinner et al. | 135/126 |
| 6,338,356 | B1 | 1/2002 | Wallenstatter | 135/90 |
| 6,357,462 | B1 * | 3/2002 | Laosunthara et al. | 135/96 |
| 6,371,143 | B1 | 4/2002 | Swetish | 135/125 |
| 6,474,025 | B1 * | 11/2002 | Faiks et al. | 52/36.1 |
| 6,532,701 | B2 * | 3/2003 | Williams | 52/71 |
| 6,877,521 | B2 | 4/2005 | Webster et al. | 135/115 |
| 6,892,742 | B2 | 5/2005 | Wang | 135/125 |
| 7,040,333 | B1 * | 5/2006 | Ransom et al. | 135/126 |
| 2004/0168715 | A1 * | 9/2004 | Wang | 135/124 |
| 2005/0092355 | A1 | 5/2005 | Hsu | 135/125 |

FOREIGN PATENT DOCUMENTS

DE 10332408 A1 * 11/2004

* cited by examiner

*Primary Examiner* — Winnie Yip
(74) *Attorney, Agent, or Firm* — Apex Juris, pllc; Tracy M. Heims

(57) ABSTRACT

A support system for tents and other shelters. The support system includes base support members that are in the shape of an arch. These base support members are secured in a desired configuration by an upper support member that is in the shape of a circle or other geometrical shape. A roof support may be added as well. The size and configuration of the shelter may be easily changed by adding or deleting the number of base support members.

29 Claims, 19 Drawing Sheets

SUPPORT SYSTEM FOR SHELTERS

FIELD OF THE INVENTION

This invention relates to the field of tent and other shelter structures.

BACKGROUND OF THE INVENTION

Tents are used for a wide variety of purposes ranging from camping, for storage, for day use shelters, for commercial purposes and many other purposes. Each use typically requires a particular size, shape and configuration. For example, a camping tent may range from a small backpacking tent to a larger expedition tent to a multiple person family style tent. A backpacking tent may include two or more support poles that are supported together by tent materials and tensioning cords. A larger expedition tent may require multiple poles that require tensioning cords. The structures that support these tents are relatively complex to assembly and are not free-standing without the tent covers and/or tensioning cords. The larger family style tents and even commercial use tents require multiple components and the use of tension cords and stakes. Also, the roof structure is designed as part of the tent and is not able to changed.

Another area that is currently being expanded is the use of a tent structure to expand the use of vehicles. For example, it is becoming popular to use a tent structure with a camping vehicle such as a recreational vehicle or camping trailer to create more usable space. The tent structures currently being used tend to be complex and only suitable for a particular vehicle.

Another area where tent structures are becoming popular is as temporary or semi-permanent storage facilities. Often it is desirable to store equipment, vehicles or other items in places where no permanent storage is available. However, most of these temporary structures are complex and not easily set up.

Each different use normally requires an additional tent. This can become expensive as well as requiring space for storage and transport. Additional tents may be required if additional space is needed. Also, an existing tent may be too large for many purposes.

There presently is a need for a tent support system that may be configured in many different shapes and sizes and for many different purposes.

SUMMARY OF THE INVENTION

The present invention provides a tent support system that can be easily set up in many different configurations. The system provides a support system for tents, shelters and other uses that is stable in any configuration. The base system includes three or more wall supports. The number of wall supports provides the configuration of the tent structure. A number of roof options enable the tent structure to have a dome roof, a flat roof, a gable roof, an adjustable roof, a roof that may be partially or fully opened or any other type of desired roof. The tent may be used with a fully enclosed tent cover or with removable panels. The base system may be easily reconfigured in any number of shapes and configurations.

A preferred embodiment of the present invention provides a base structural component to create the support system. The base structural component of this preferred embodiment is an arch support member. This arch support member can be pre-bent into a wall support but preferably includes a plurality of shock corded sections. These sections when assembled are sufficiently flexible to form the arch support. Three or more of these arch support members are secured to one another to form the walls of the tent structure. A roof section may be secured to the top portions of these arch support members. A tent cover may then be attached to either the interior or the exterior of the support members.

A ring member in one preferred embodiment of the present invention is secured to the upper portion of the arch support members. This provides additional stability and strength to the wall supports and enables it to be free-standing.

A roof section may be added to the upper portion of the arch support members in another preferred embodiment of the present invention. The roof section can be a fixed dome, an adjustable dome, a roof section that can be partially or completely opened, a flat roof, square roof or other shapes and types of roofs. Different roof sections can be used with the base configuration.

Another preferred embodiment of the present invention provides removable panels that are attached to the base wall systems. The removable panels can include walls, doors, windows, screen mesh or other types of panels for use with the base configuration.

In additional preferred embodiment of the present invention allows the base configuration to be expanded as desired. This is accomplished by simply adding additional arch support members to the original arch support members. This allows the nesting or ganging of the arch support members together to create additional compartments that are in communication with one another.

The present invention in another preferred embodiment may be mounted on the open compartment of a pick-up truck or other vehicle. The arch support members are mounted on the cargo compartment to create a tent structure on the cargo compartment. This can also be done on an open trailer as well.

These and other features are evident from the ensuing detailed description of preferred embodiments and from the drawings.

DETAILED DESCRIPTION OF PREFERRED EMBODIMENTS

Figure 1:
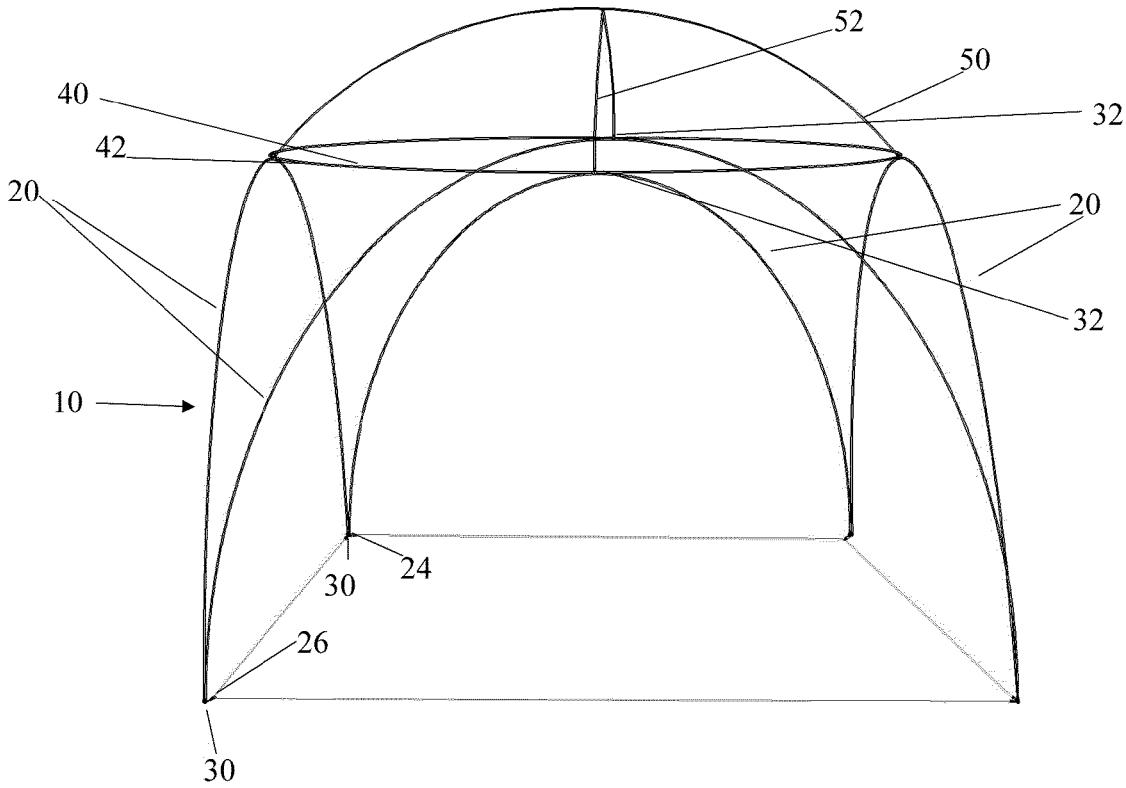
FIG. 1 is a view of the tent structure system of a preferred embodiment of the present invention.
Figure 2:
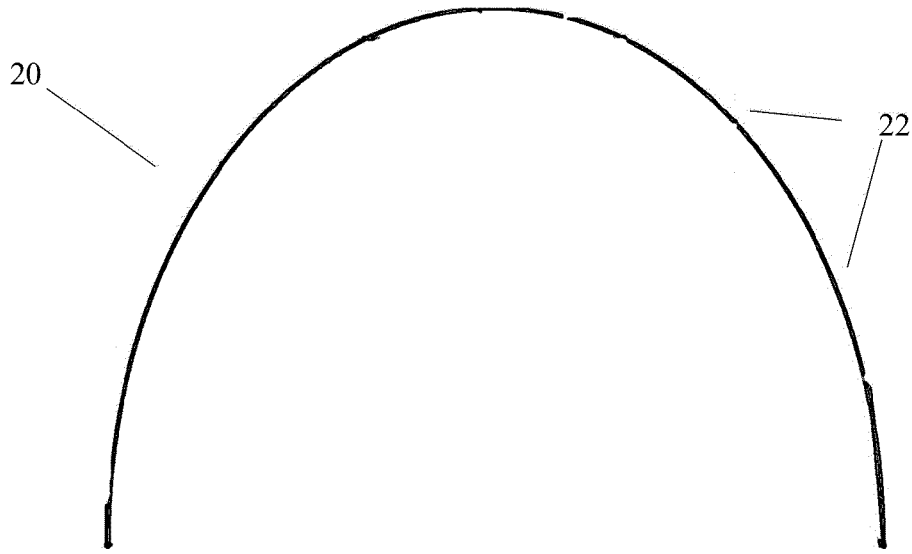
FIG. 2 is a view of the arch support member of the embodiment of FIG. 1.

The present invention, in a preferred embodiment, provides an improved tent frame system that is easily configurable in a variety of configurations. A preferred embodiment of the present invention is described below. It is to be expressly understood that this descriptive embodiment is provided for explanatory purposes only, and is not meant to unduly limit the scope of the present invention as set forth in the claims. Other embodiments of the present invention are considered to be within the scope of the claimed inventions, including not only those embodiments that would be within the scope of one skilled in the art, but also as encompassed in technology developed in the future.

A preferred embodiment of the present invention is illustrated in FIGS. 1-4. The tent frame 10 shown in FIG. 1 of this embodiment is easily configurable into a number of options. The basic component of the tent frame 10 is the arch support member 20. The arch support member 20 shown in FIG. 2, in this preferred embodiment, is formed of sections 22 of anodized aluminum tubing shock corded together. It is to be expressly understood that other materials may be used as well including plastic, steel, titanium, wood, or any other structural material. In this embodiment, the arch support members are pre-bent to reduce the stress of the arches and rings as discussed below. However, the arch support members are sufficiently flexible to bend in place even without being pre-bent. The arch support sections 22 can be separated for compact storage. The use of a shock cord provides additional ease in the assembly of the individual arches. Also, additional sections may be added to increase the size of the arch support members. Other sizes and shapes of sections may be used as well to provide additional strength if needed.

In one alternative preferred embodiment, the structural components of the arch support members, the ring members and the dome support members may be formed as pneumatic support tubes. The inflatable tubes are formed of materials similar to bicycle tubes, or of other durable pneumatic tubes. These tubes can be inflated in place as they are assembled or pre-inflated.

It is to be expressly understood that even though the support members 20 are described as arches, that other geometric configurations could be used as well. For example, the support members could be in the shape of a square, triangle, circle, or any other shape.

The arch support member 20 forms a wall support for the tent systems. A plurality of the arch support members are secured together at their end portions 24, 26 by fastening mechanisms 30 such as c-clip fasteners, tent sleeve fasteners, hook and loop fasteners, or any other type of fastening mechanisms. The end portions 24, 26 are also tensioned together by ropes, cords, webbing or other types of tension mechanisms. Also, as discussed in greater detail below, the end portions can also be tensioned by a floor. The tensioning of the lower end portions 24, 26 provides a stable structure.

Ring support member 40 secures the arch support members together as well to form an integral support frame. The ring support member 40 is secured to each of the upper center portions 28 of the arch support members 20 by straps, hook and loop fastener straps or any other type of fastening mechanism 32. The ring support member 40 is formed from multiple sections 42 that are shock corded together. These sections are formed from similar materials as the arch support sections 22.

The arch support members 20 may be oriented inward, outward or vertical depending on the diameter of the ring member compared with the diameter of the base. The flexibility of the arch support members 20 enable the base perimeter to be expanded or decreased to change the orientation of the side walls formed by the arch support members.

Figure 3:
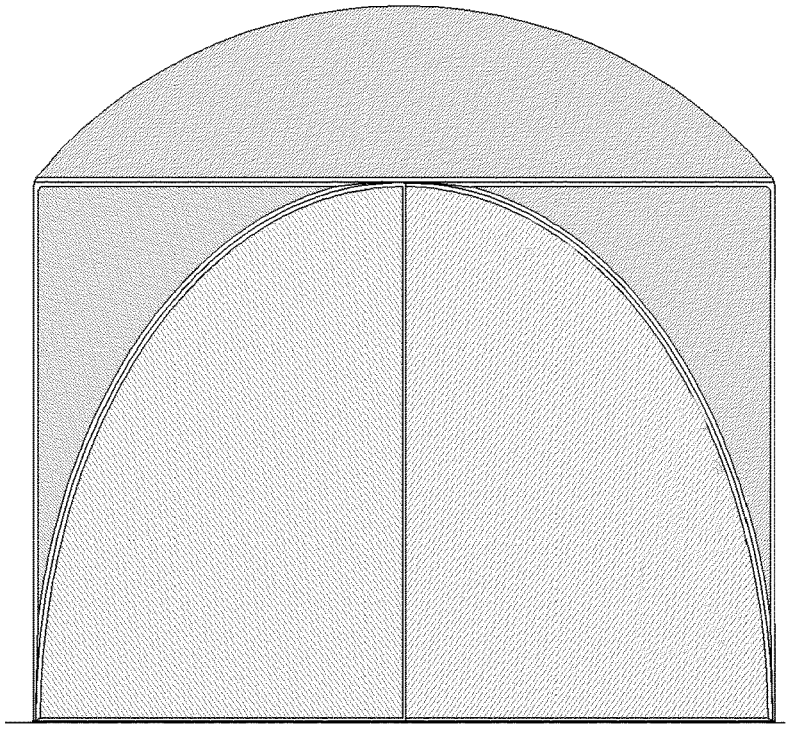
FIG. 3 is a front view of a covered embodiment of the system of FIG. 1.

The arch support members 20 and ring support member 40 form a simple yet extremely stable tent support system. The system may be used freestanding without the need of a tent cover material. A tent cover material may be quickly and easily fastened to the tent support system as shown in FIG. 3. The tent fabric is simply attached to the ring support member 40 and arch support members 20 by tent sleeves, hook and loop fasteners, c-clips or any other type of fastening mechanisms. The tent fabric can be fastened over the ring member and support members or internally with the ring member and support members forming an external support system. Doors and windows may be incorporated in the tent fabric.

In one preferred embodiment, the tent fabric includes a series of attachable panels. This allows a panel to be entirely or partially removed to form a door, or replaced with a screen mesh or transparent panel. The panels may be zippered together of fastened by other fastening mechanisms. The tent may include side panels, roof panels and floor panel that may all be fastened together to form the skin of the tent. The floor panel also provides a tensioning mechanism for preventing the lower ends of the arch support members from moving.

The configurable system may be used with a fixed roof, an adjustable roof to allow the roof to be partially or completely opened or closed or with no roof at all. The roof panels may include a screen mesh, a fly cover, a zippered panel, a transparent skylight panel or other variations. The present system is designed to allow the base frame system to be used with various roof options.

Configurations

Four Sided Tent Configurations

This tent support system is able to configured in numerous ways to create a plurality of options for use. For example, as shown in FIGS. 1 and 3, four arch support members 20 and ring member 40 are secured together to form a square tent structure. A fixed dome support 50 is added to the basic tent support by securing dome support members 52, 54 at the center portions 28 of the arch supports. The centers of the dome support members 52, 54 can be fastened together as well. The tent fabric is secured either over or under the dome support members 52, 54. This provides additional head room within the tent.

Figure 4:
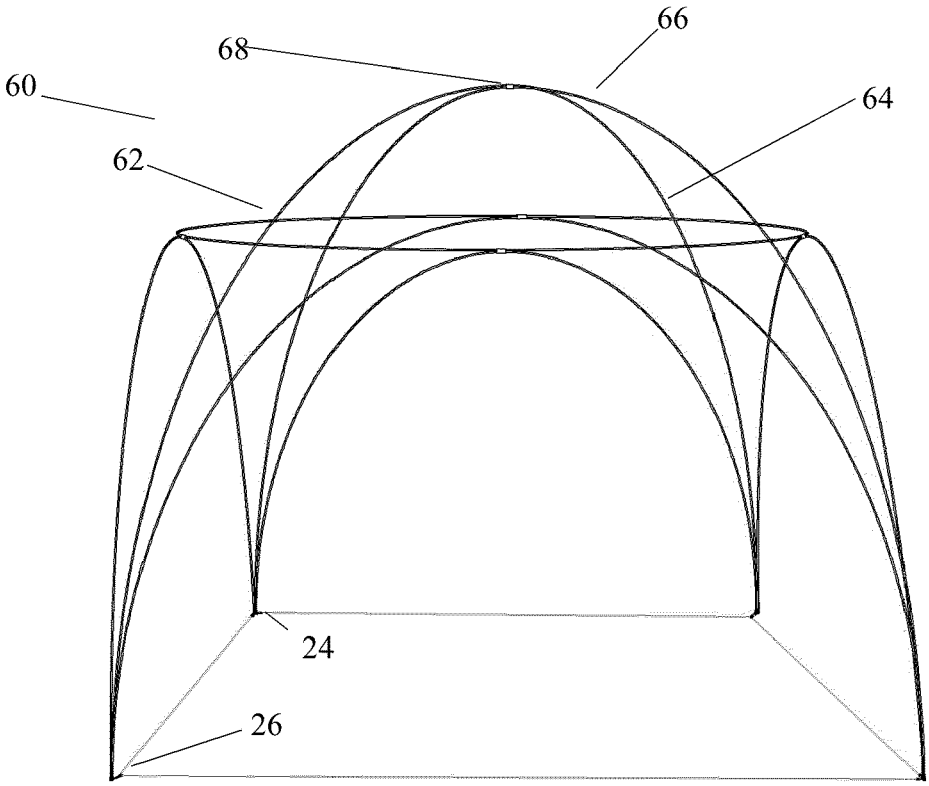
FIG. 4 is a view of an alternative roof on the embodiment of FIG. 1.

An alternative configuration is shown in FIG. 4 that also provides a fixed dome support 60. Dome support members 62, 64 are fastened to the end portions 24, 26 of the arch support members by the fastening mechanisms discussed above. These dome support members extend above the ring member 40 to create the dome structure 66 in the tent. The center portions of the dome support members can be secured together by fastener 68.

Figure 5:
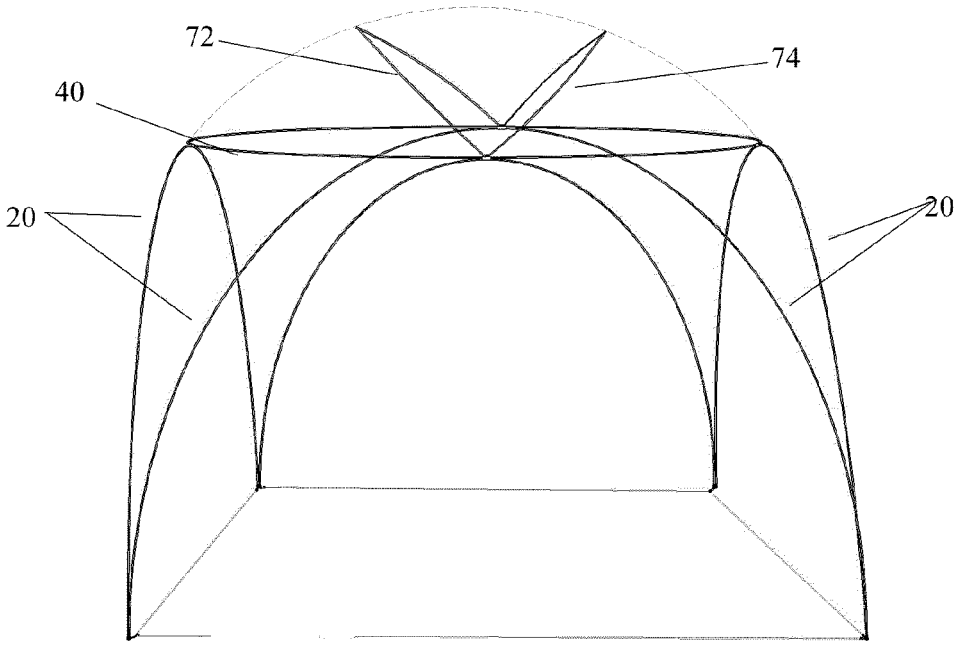
FIG. 5 is a view of an alternative roof on the embodiment of FIG. 1.

Another dome configuration is shown in FIG. 5. This embodiment uses dome support members 72, 74 to form a dome support 70. The dome support members 72, 74 extend angularly upwards from the ring member 40 at the center support 28 of two opposing arch support members 20. The top tent fabric may also include a zipper or other fastening mechanism to allow the top to be partially removed to provide a skylight. A transparent portion may also be incorporated into the top tent fabric portion.

Figure 6:
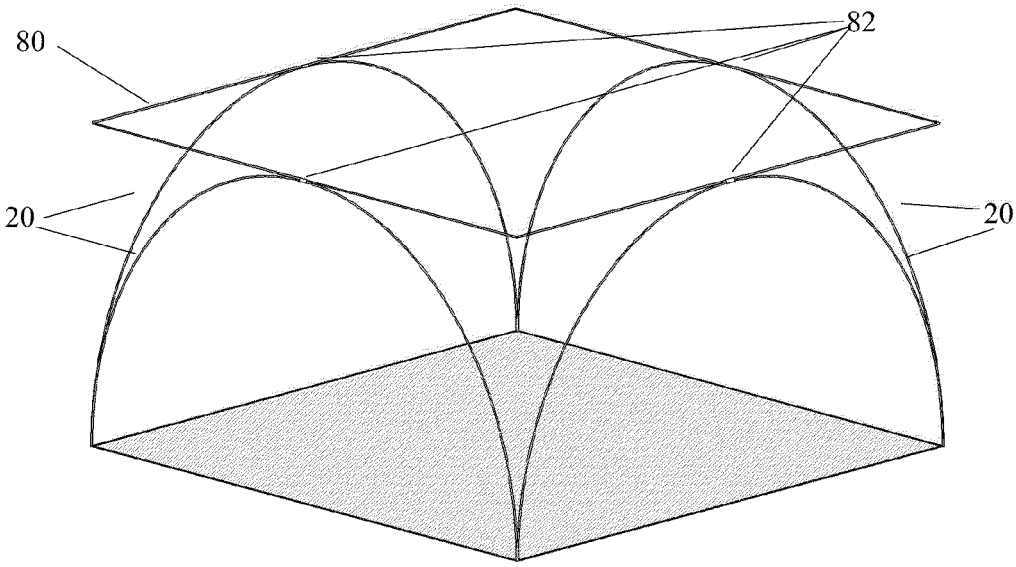
FIG. 6 is a view of an alternative roof on the embodiment of FIG. 1.
Figure 7:
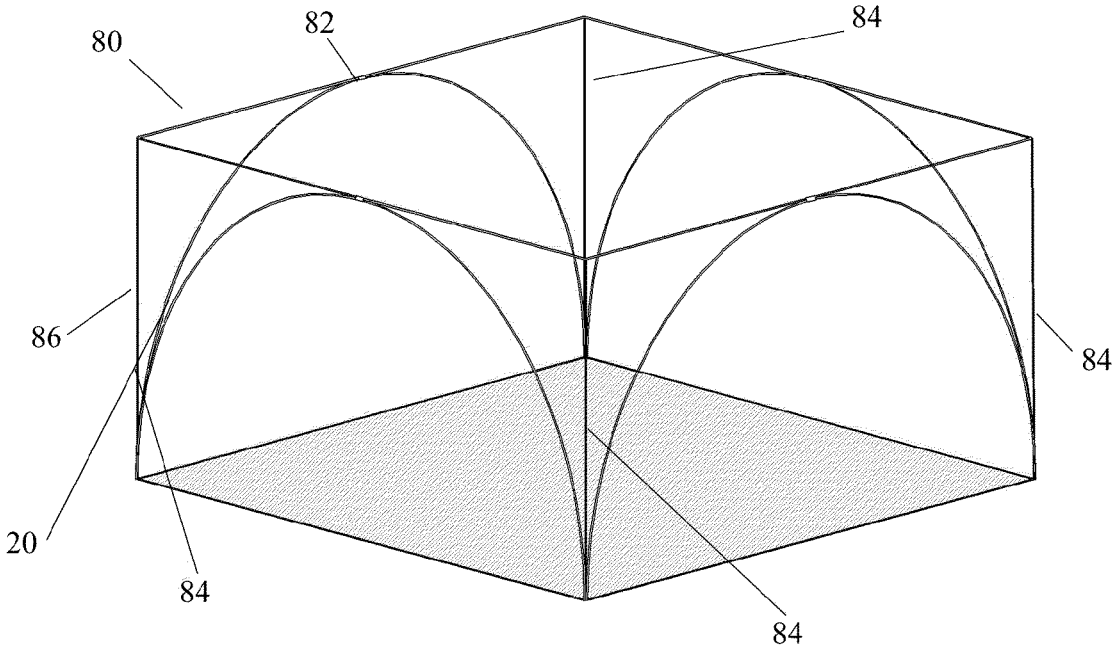
FIG. 7 is a view of an alternative roof on the embodiment of FIG. 1.

An alternative upper support member 80 is shown in FIG. 6. The square upper support member 80 replaces the ring member 40 and is attached to the center portions 28 of the arch support members 20*s* by fasteners 82. This configuration provides an overhang over the tent structure. Support poles 84 shown in FIG. 7 may be used to provide additional support to the tent structure. The upper support member 80 may include separable components 86 for ease of packing and storing.

Figure 8:
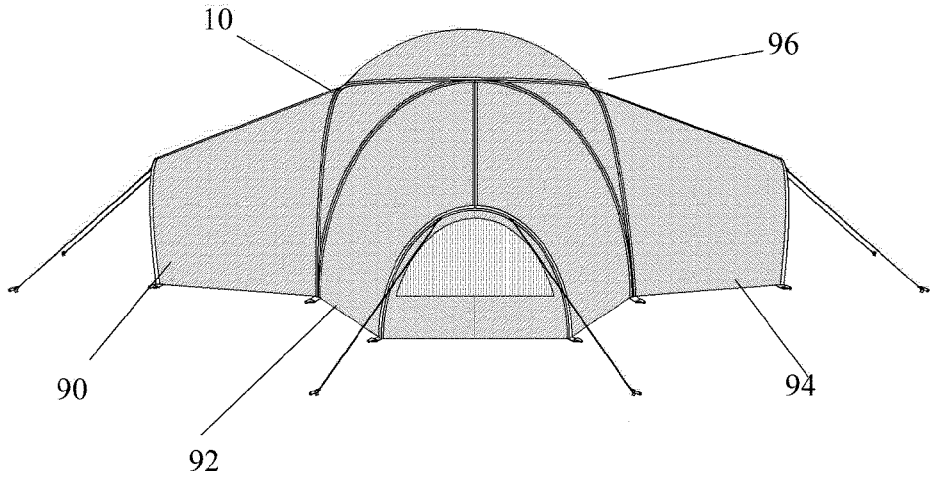
FIG. 8 is a view of an expanded configuration of the embodiment of FIG. 1.
Figure 9:
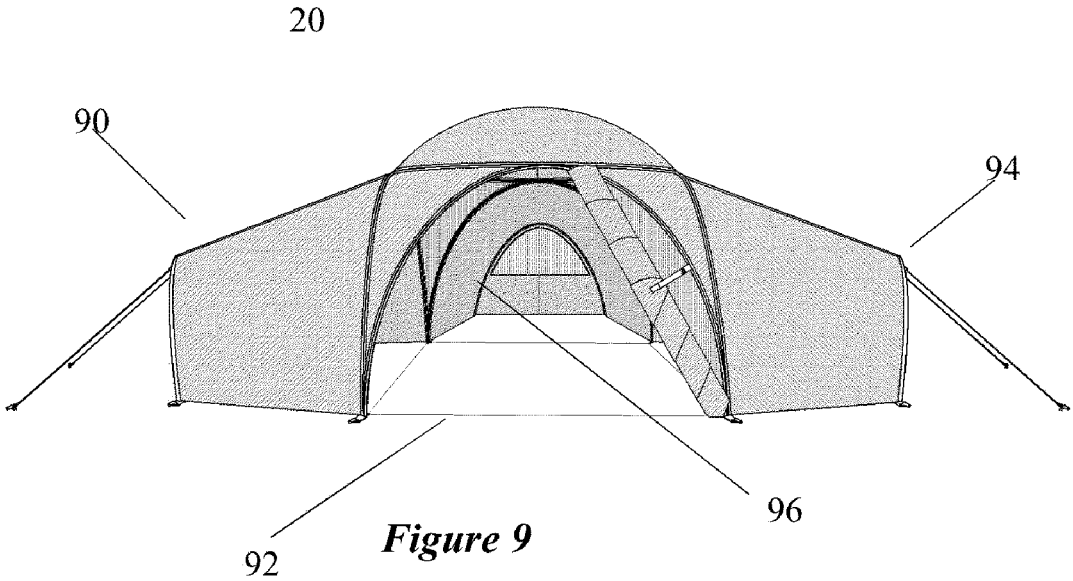
FIG. 9 is a view of an expanded configuration of the embodiment of FIG. 1.

Another configuration of this preferred embodiment is illustrated in FIGS. 8 and 9. This embodiment utilizes the same support structure as shown in FIG. 1. Vestibules 90, 92, 94, 96 are attached to each of the four arch support members 20. No additional support structure is needed. Each vestibule can include doors or window flaps if desired. This provides extensive additional storage or sleeping compartments. It is to be expressly understood that less than four vestibules can be used in this configuration.

Figure 10:
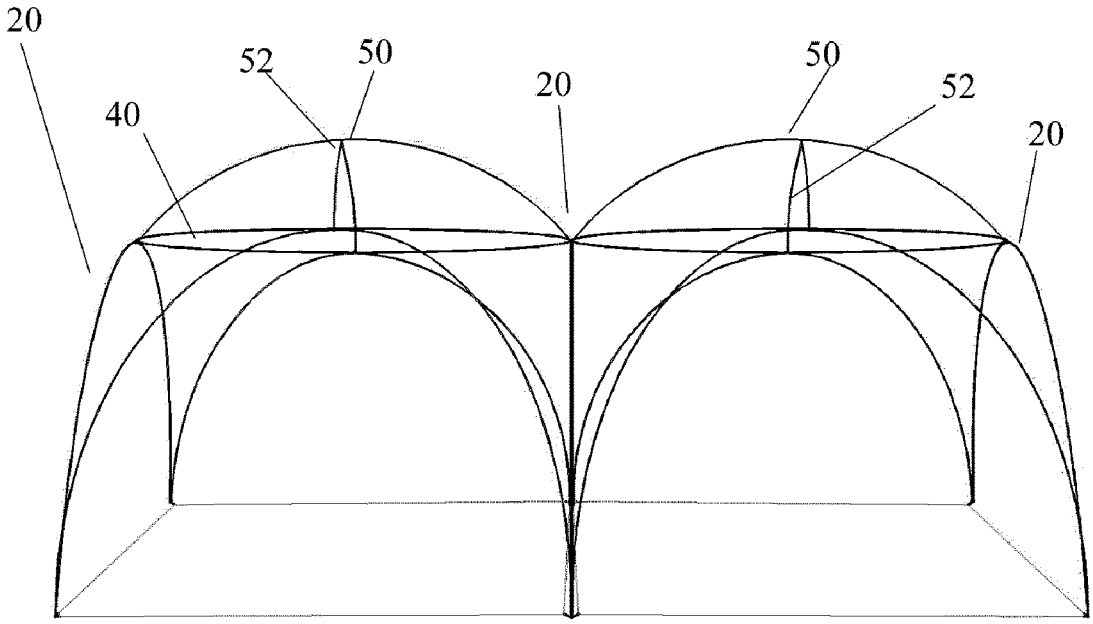
FIG. 10 is a view of the tent support system of an expanded configuration of the embodiment of FIG. 1.
Figure 11:
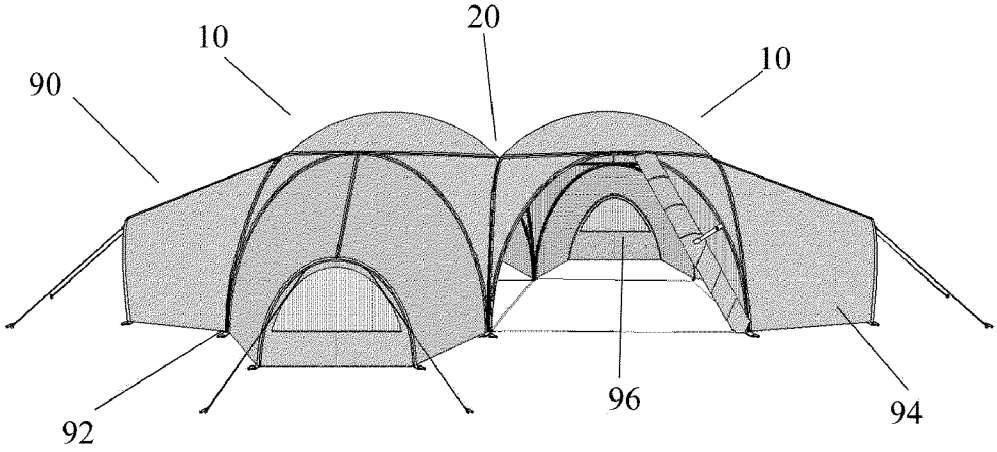
FIG. 11 is a view of the covered support system of FIG. 10.
Figure 12:
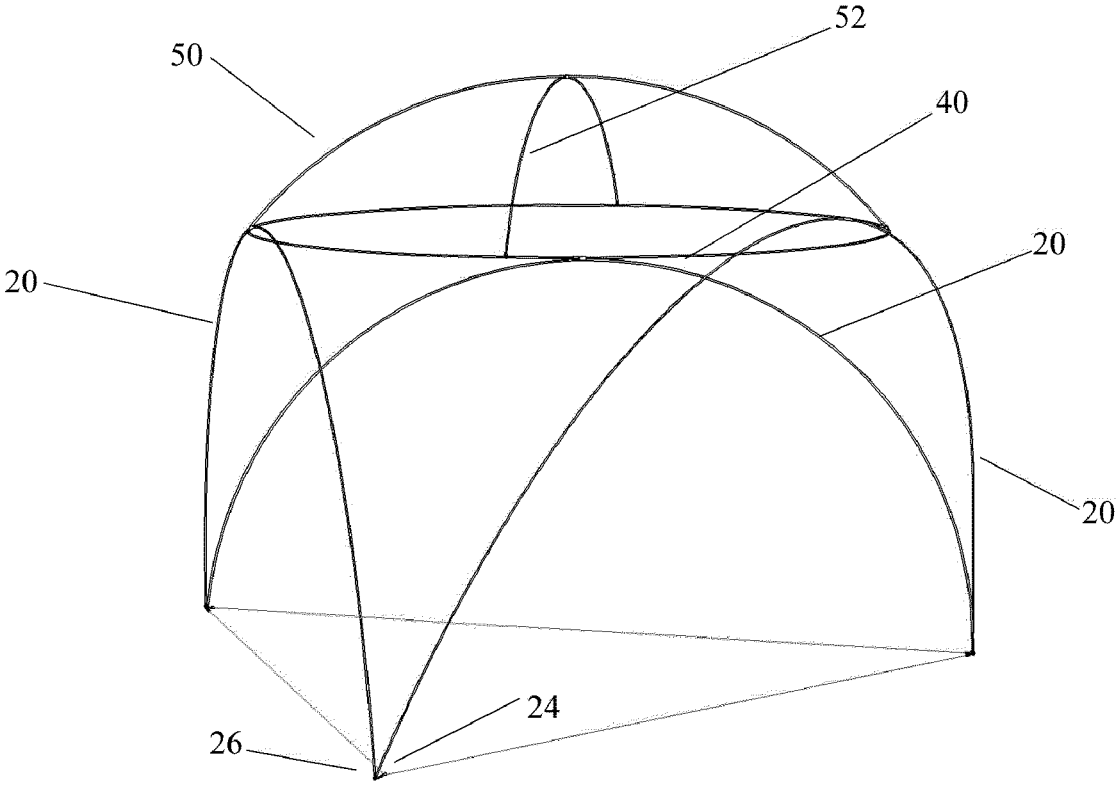
FIG. 12 is a view of a three-sided configuration of the present invention.

Another configuration of this preferred embodiment is illustrated in FIGS. 10 and 11. The same configuration of the arch and dome support members as shown in FIG. 1 are used with additional arch support members secured to arch support member 100 to create an additional tent or shelter that opens into the original tent or shelter. Ring support member 102 and dome support member 104, similar to the members discussed above provide a roof to the tent. Additional vestibules may be secured to the arch support members as well.

Additional support members may be added as well to create an infinite number of rooms that open into one another. Privacy walls may be added with flaps that allow communication into one another.

Three Sided Tent Configurations

Figure 13:
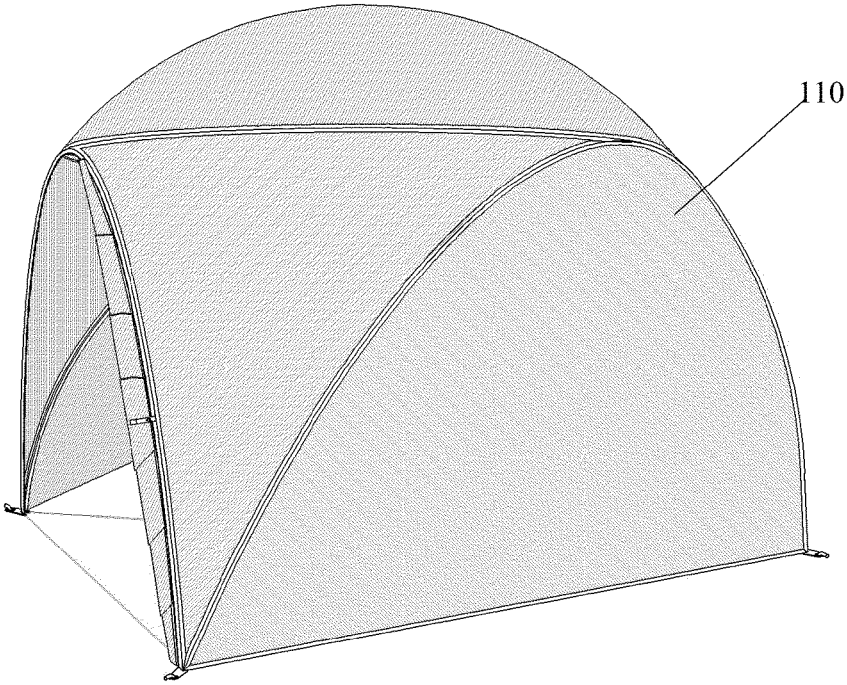
FIG. 13 is a view of the covered support system of FIG. 12.
Figure 14:
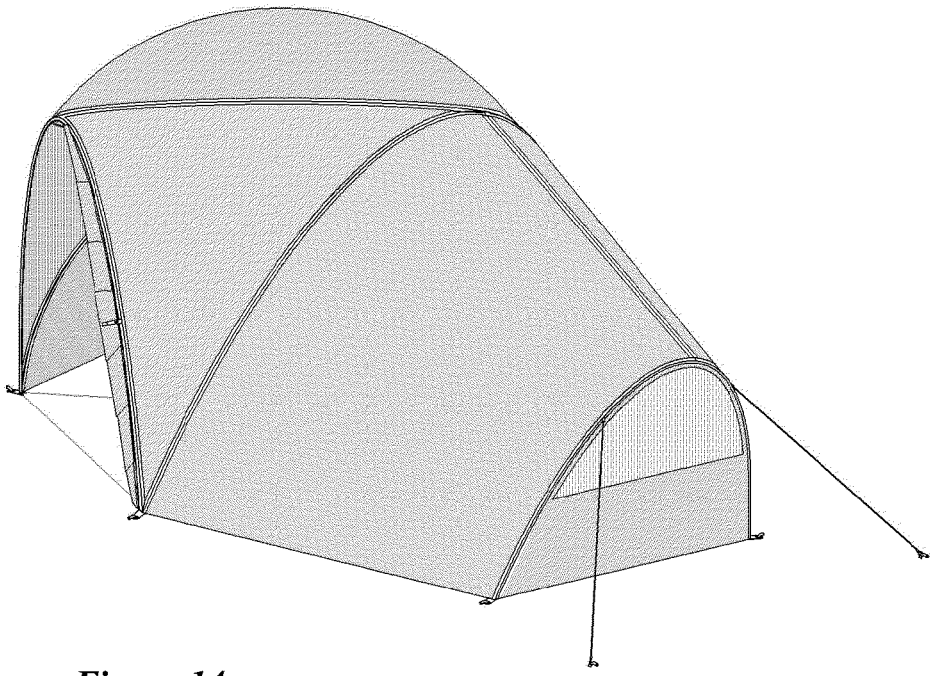
FIG. 14 is a view of the configuration of FIG. 13 with a vestibule.

Another preferred embodiment is illustrated in FIGS. 12-18. This configuration utilizes the same arch support members 20 as discussed above. The arch support members 20 in this preferred embodiment are arranged in a contiguous three sided arrangement. Ring member 40 is used to secure the arch support members together. A dome member 50 provides a fixed roof support. Cover 110 is secured to this framework as shown in FIG. 13. The cover can be of any typical tenting material. One or more vestibules can be added as shown in FIG. 14.

Figure 15:
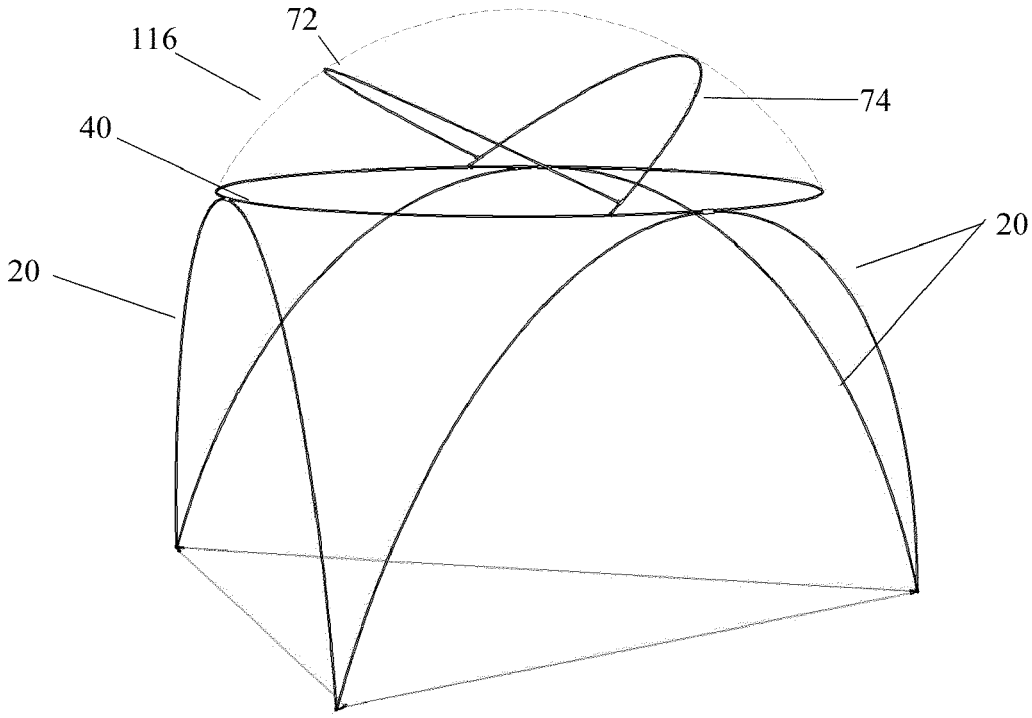
FIG. 15 is a view of the configuration of FIG. 12 with an adjustable dome system.
Figure 16:
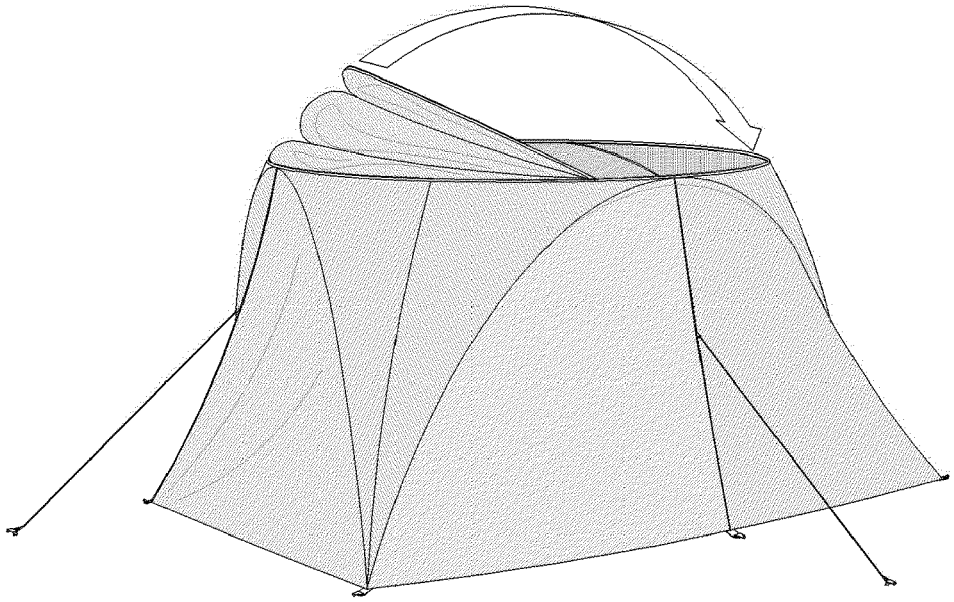
FIG. 16 is a view of the covered system of FIG. 15.
Figure 17:
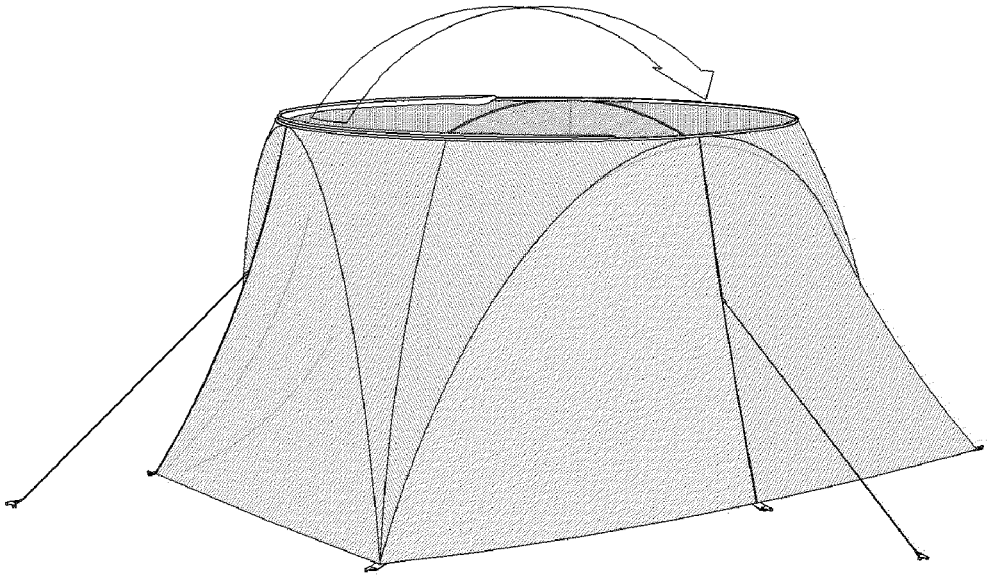
FIG. 17 is a view of the system of FIG. 16 fully open.

This embodiment may also be used with a movable dome member 116 as shown in FIGS. 15-17. This allows the top tent cover to be partially or completely pulled back or removed while allowing the side and bottom tent portions to remain intact. This configuration is particularly useful for such uses as a hunting blind, astronomy or other uses where viewing the outside environment is desired. The three-sided arrangement provides a less bulky structure as well.

Figure 18:
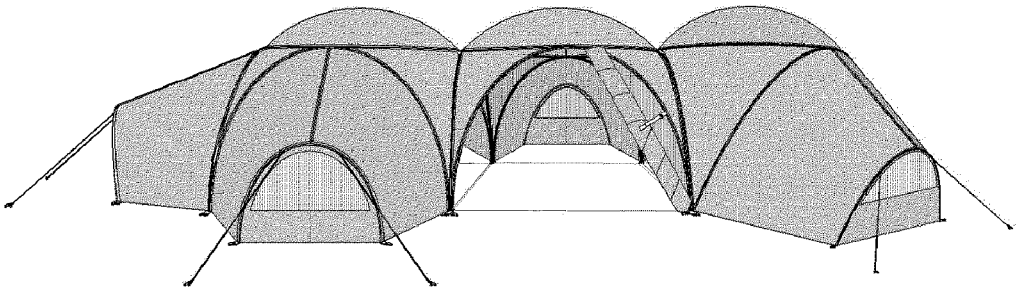
FIG. 18 is a view of the combined systems of FIG. 1 and FIG. 12 nested together.

This embodiment may also be configured into a larger structure by ganging the arch support members together to form multiple rooms. These can be used with the four sided configurations as shown in FIG. 18.

It is to be expressly understood that the arch support members may be used in numerous other geometric configurations. The ring members may need to be extended to accommodate other configurations but that is well within the present invention. One important feature of the present invention in this preferred embodiment is the ability to orient the walls inward, outward or perpendicular in a easy manner. This is accomplished by changing the diameter of the ring member 40. If the diameter of the ring member 40 is reduced, this will cause the arch support members to angle inward. If the diameter of the ring member 40 is increased, this will cause the arch support members to angle outward.

Other Uses

Figure 19:
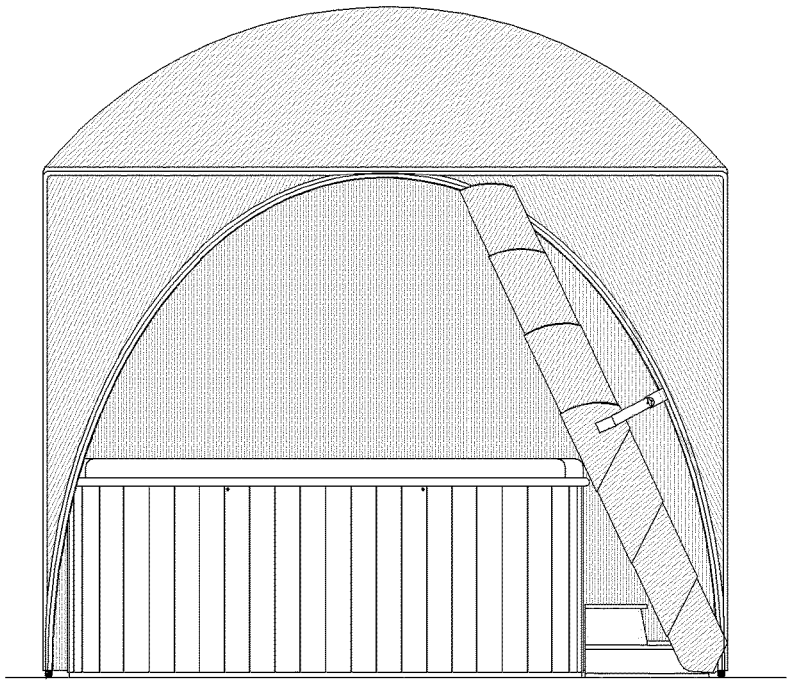
FIG. 19 is a view of the system of FIG. 1 in use with a hot tub.

The present invention has incredible utility as stand alone shelters as well in combination with other structures. For example and without limitation, the four sided configuration illustrated in FIG. 1 may be used with only a top tent cover as an outdoor sun shelter, concession stand, trade show booth or other similar uses. They may be ganged together to form virtually any size or shape. One unique use is for sheltering a hot tub or sauna as shown in FIG. 19. The top or sides may be easily removed when the tub is in use or kept in place for privacy purposes. This type of shelter reduces the environmental damage to the tub as well as providing security and privacy.

Figure 20:
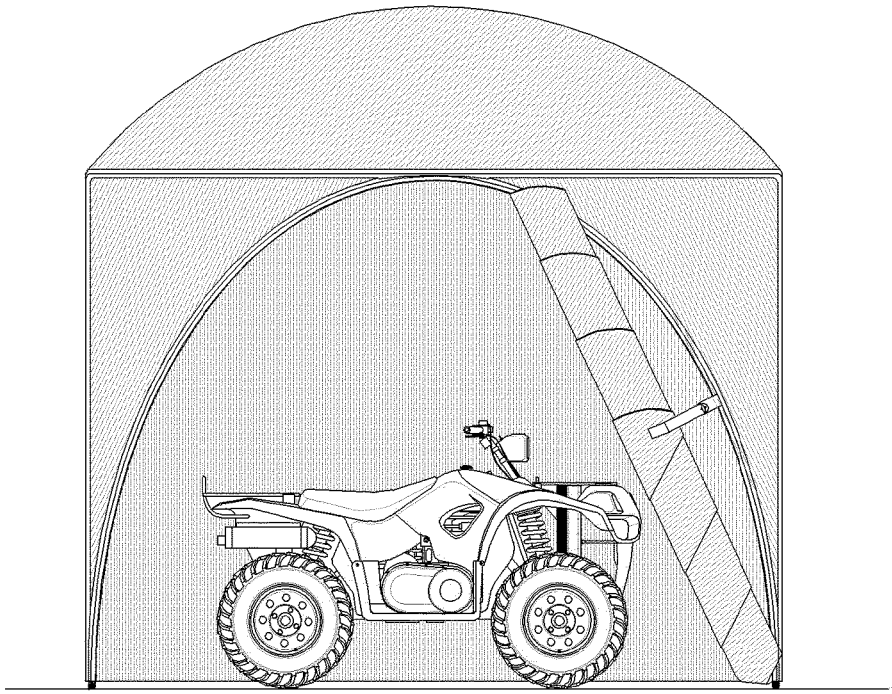
FIG. 20 is a view of the system of FIG. 1 in use as a storage tent.

Another use that the present invention is particularly suited for is for equipment storage. One example of this is illustrated in FIG. 20 for storing equipment such as all terrain vehicles (ATVs), motorcycles, bicycles, snowmobiles, etc. There is often insufficient storage space for this type of equipment at home, thus requiring them to be stored outside. This creates an unsightly appearance in residential areas as well as security issues. These shelters provide a place to securely store the equipment from environmental damage as well to hide their appearance. These same issues also occur during use of this type of equipment. It is often desirable to store this equipment during camping, hunting or other expeditions. The present invention enables this storage in a safe and secure manner.

Figure 21:
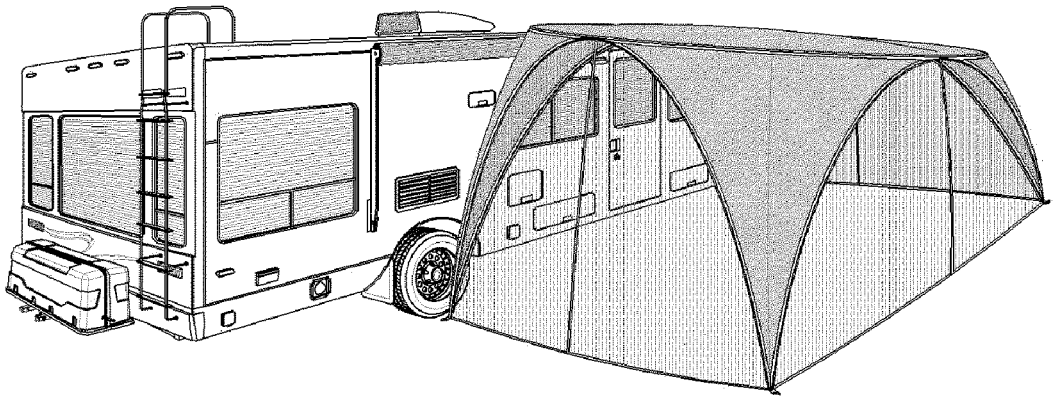
FIG. 21 is a view of the system of FIG. 1 in use with a recreational vehicle.
Figure 22:
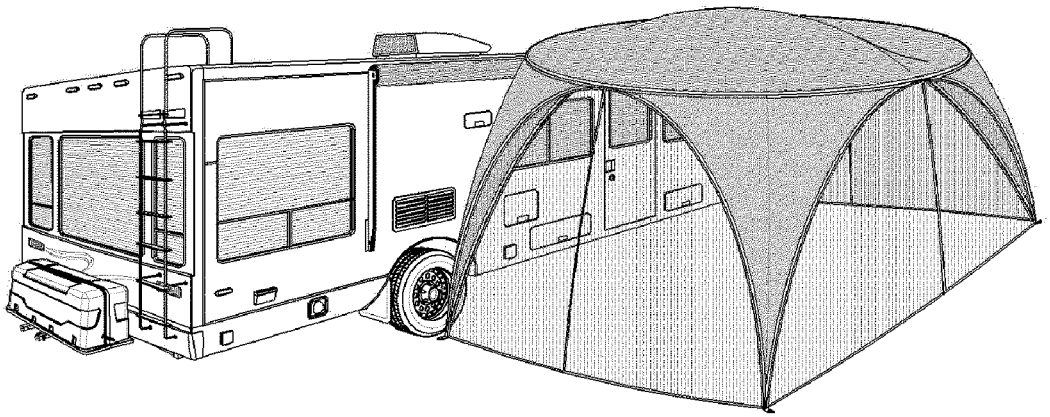
FIG. 22 is a view of the system of FIG. 21 with a dome roof.
Figure 23:
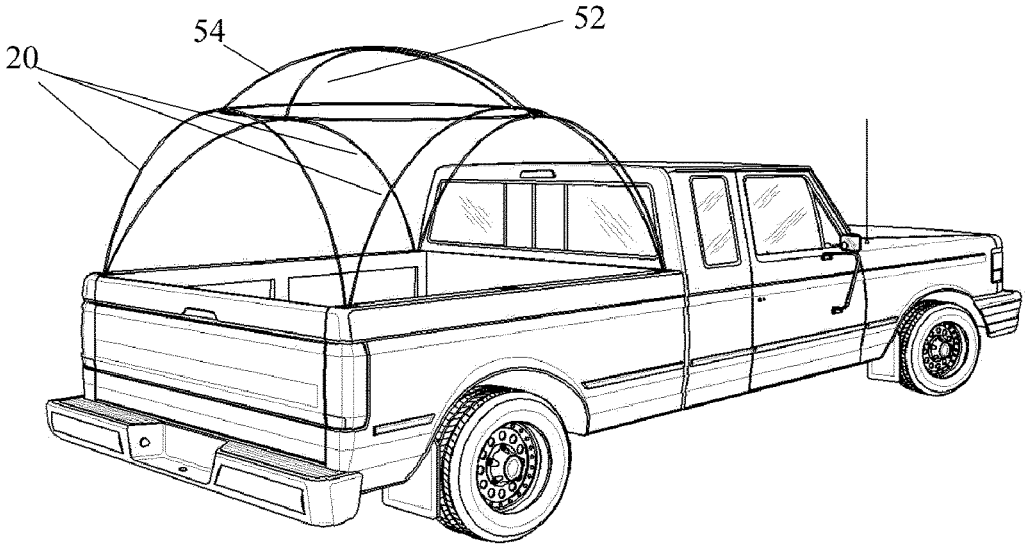
FIG. 23 is a view of the base system of the present invention used on a pick-up truck.

This present invention may also be expanded for use as semi-permanent storage shelter, such as a garage. Arch support members 20 are ganged together to provide a longer structure. Also, the tubing used in the arch support members may be of a larger diameter and thicker gauge to support a heavier covering material. The ends of the tubing may also be swaged and/or ovalized or treated in another common manner that prevents rotation of the tube sections comprising the ring and arches. The present invention may also be used in combination with other types of camping and traveling equipment. For example, as shown in FIGS. 21 and 22, the arch support members 20 and ring member 40 may be used for attachment alongside a recreational vehicle (RV). This provides a shelter that may have the sides opened with or without a screen to create a patio for the RV. This allows for relaxation and dining within a relatively private shelter outside of the RV.

Figure 24:
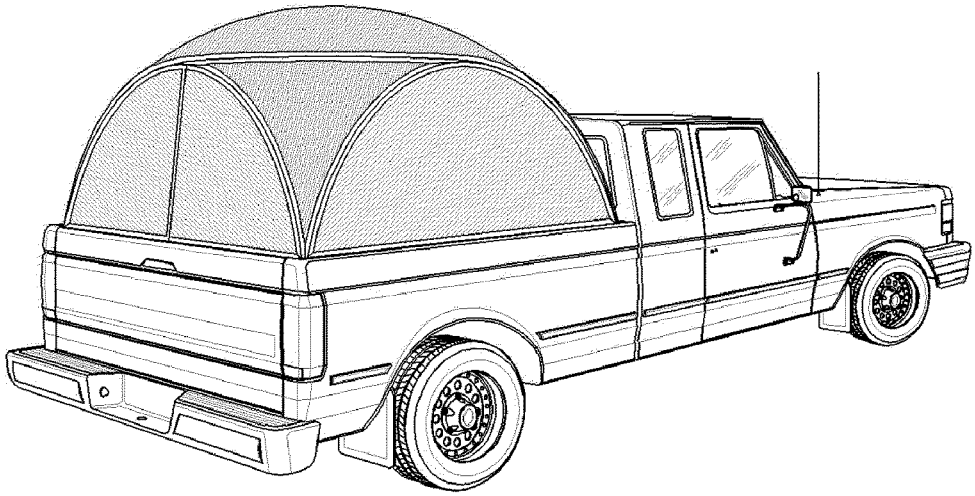
FIG. 24 is a view of the system of FIG. 23 with an adjustable roof.
Figure 25:
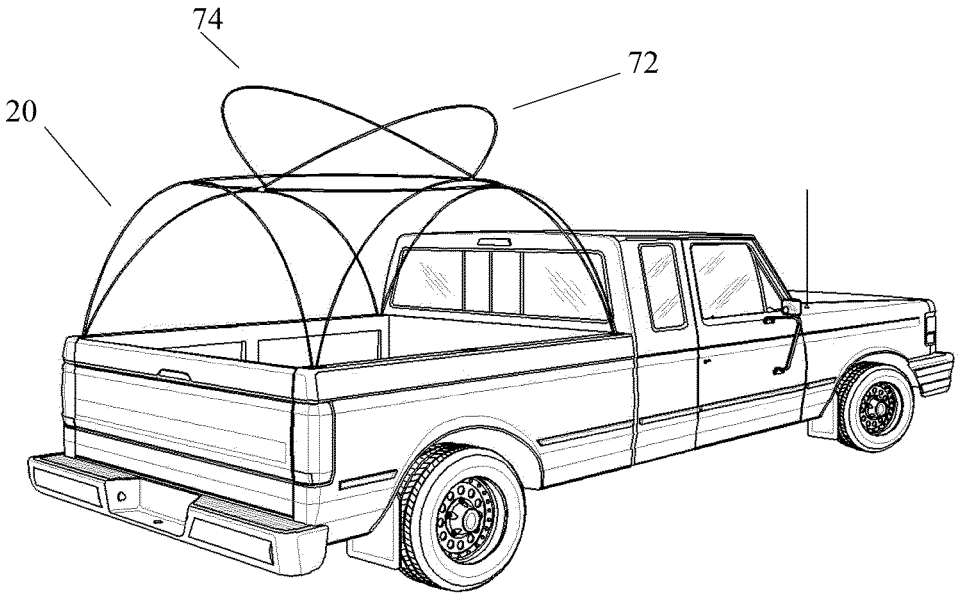
FIG. 25 is a view of the system of FIG. 23 with a cover.

Another configuration of the present invention is for use with a pick-up vehicle. Hard camping shells have often been used with these vehicles. This limits the effectiveness of the utility of the open pick-up bed. The present invention as shown in FIGS. 23-28 can be installed on the pick-up bed without modification of the pick-up bed. The arch support members 20 are installed in the stanchions or bed tracks or rails of the pick-up bed and secured to one another by the ring member 40 and fasteners. Fixed dome support members 52, 54 create a roof structure for the pick-up bed tent as shown in FIG. 24 or with movable dome support members 72, 74 shown in FIG. 24 to create an adjustable top. The tent material can then be fastened to the arch support members, dome support members and/or the pick-up bed. The tent frame can be quickly assembled and disassembled on an existing pick-up bed. The disassembled components are easily stored for compact storage.

Figure 26:
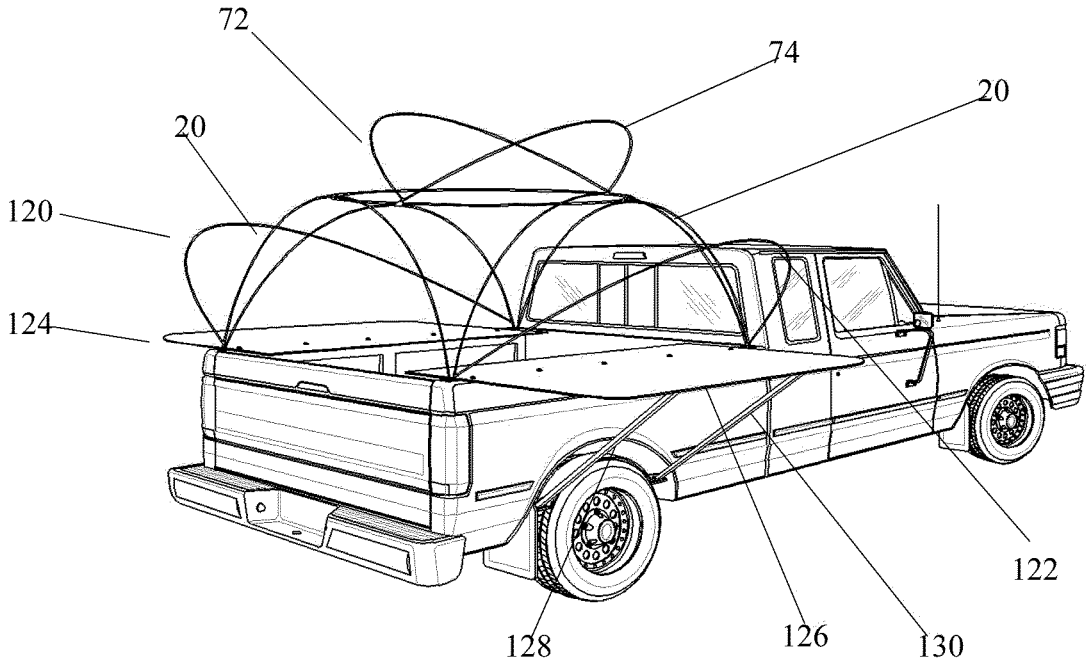
FIG. 26 is a view of the system of FIG. 23 with expanded sides.
Figure 27:
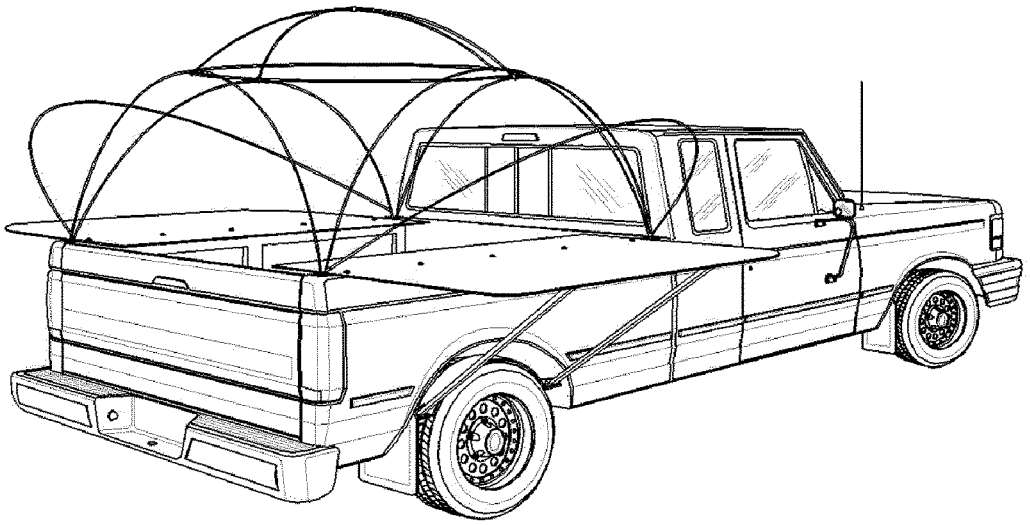
FIG. 27 is a view of the system of FIG. 26 with a cover.
Figure 28:
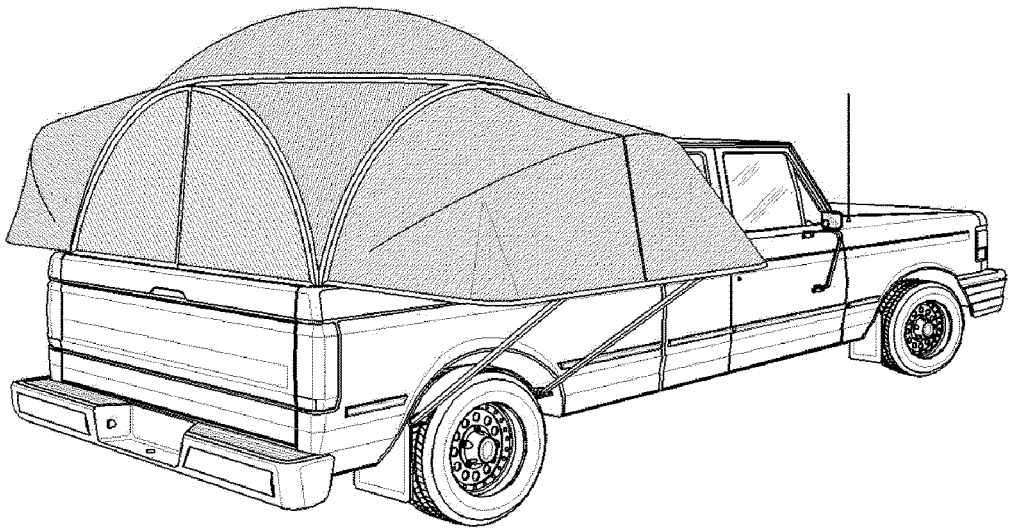
FIG. 28 is a view of the system of FIG. 1 in use with a vehicle.

Another configuration of this embodiment is illustrated in FIGS. 26-28. This configuration is similar to the above configuration with the addition of two additional support members 120, 122 extending angularly out of the pick-up bed as shown in FIGS. 26 and 27. Also, side extensions 124, 126 extend horizontally out the side of the pick-up bed. These side extensions are plywood, plastic or other materials and are supported by braces 128, 130. The tent material extend over the arch support members 120, 122 and side extensions 124, 126 to create sleeping or storage compartments as shown in FIG. 28.

Figure 29:
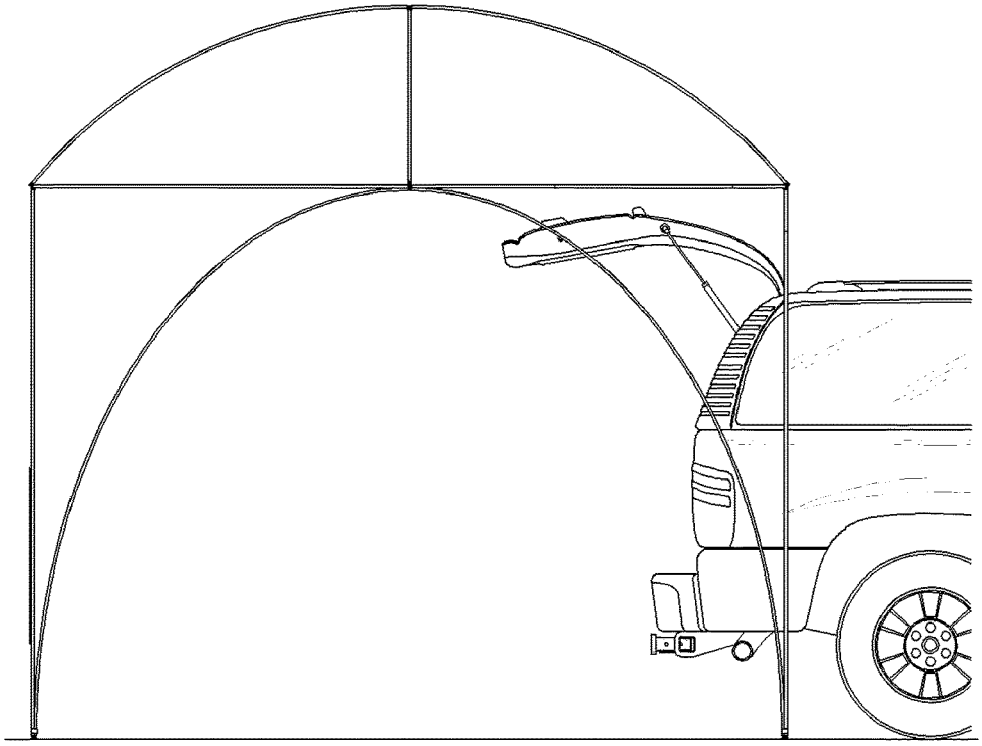
FIG. 29 is a view of the system of FIG. 28 with a cover.
Figure 30:
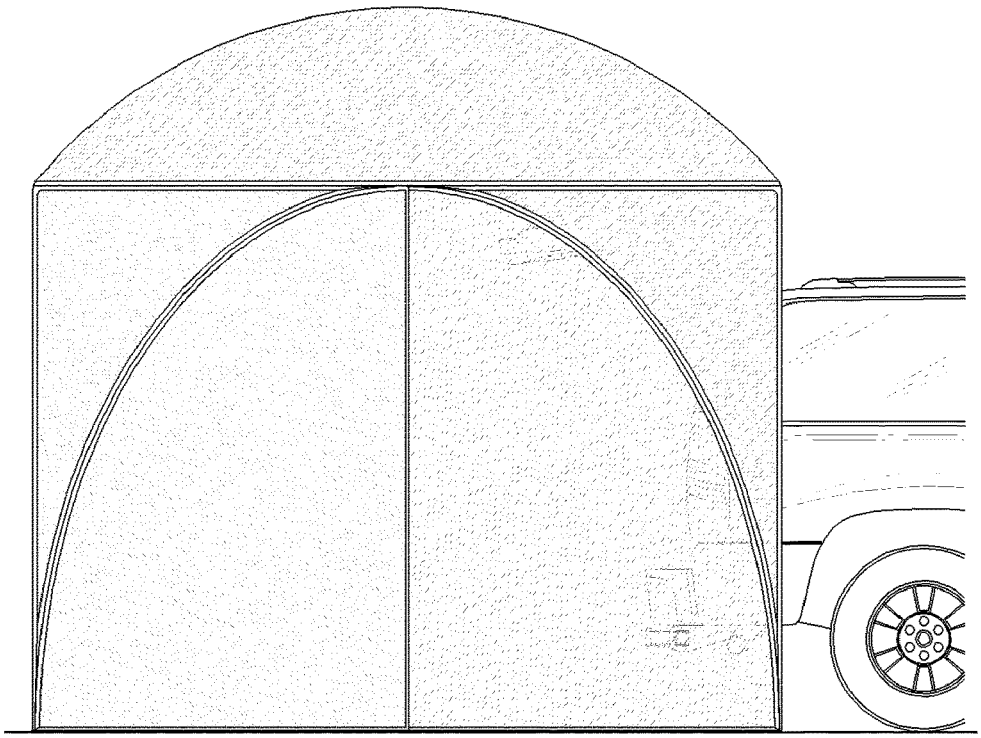
FIG. 30 is a view of the system of FIG. 1 in use with a camping trailer.

FIGS. 29 and 30 illustrate another configuration of the preferred embodiment of the present invention. This configuration illustrates the utility of the tent arch support members used with a vehicle such as a sports utility vehicle, van, or other types of vehicles. The arch support members 20 are formed in a preferred configuration such as the four-sided configuration shown in FIGS. 29 and 30. The ring member 40 and dome members 52, 54 are oriented over the open tailgate or door of the vehicle. This allows the vehicle interior to be in direct communication with the tent or shelter. The tent material is secured over the arch support member and the dome members and can be secured or draped over the vehicle tailgate or door.

Figure 31:
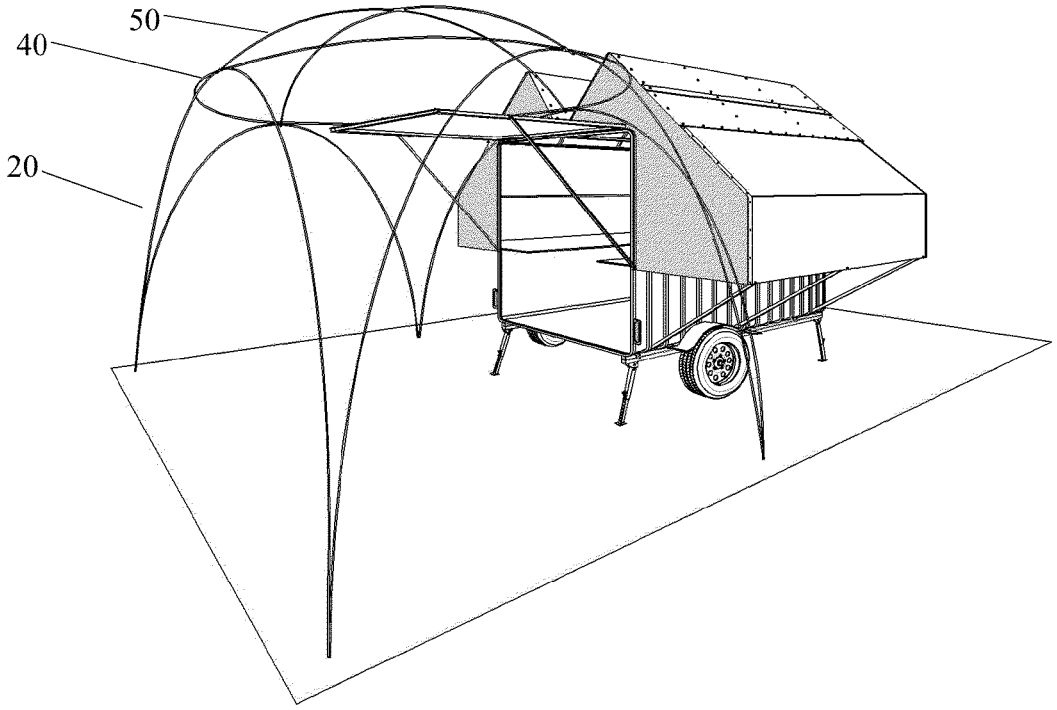
FIG. 31 is a side view of the system of FIG. 30.
Figure 32:
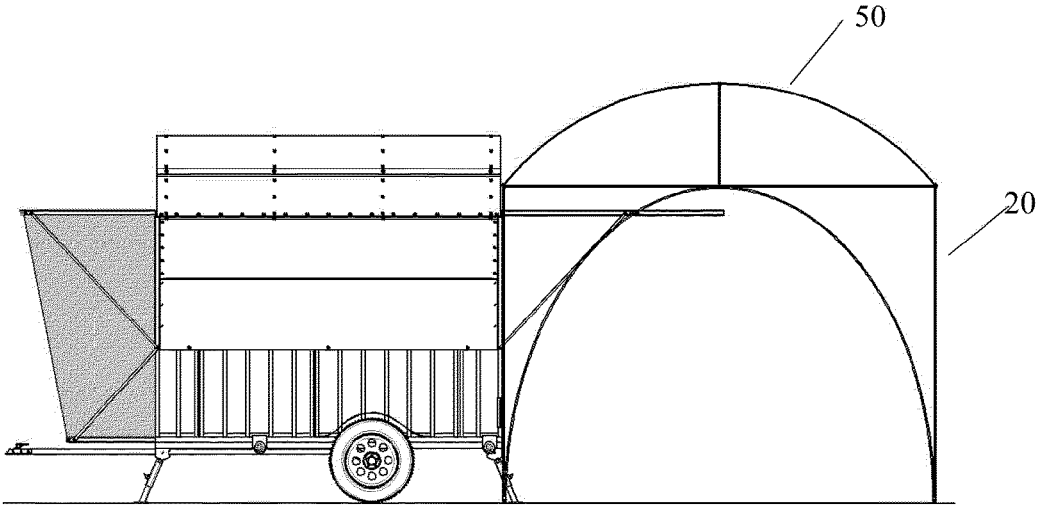
FIG. 32 is an end view of the system of FIG. 30 with a cover.
Figure 33:
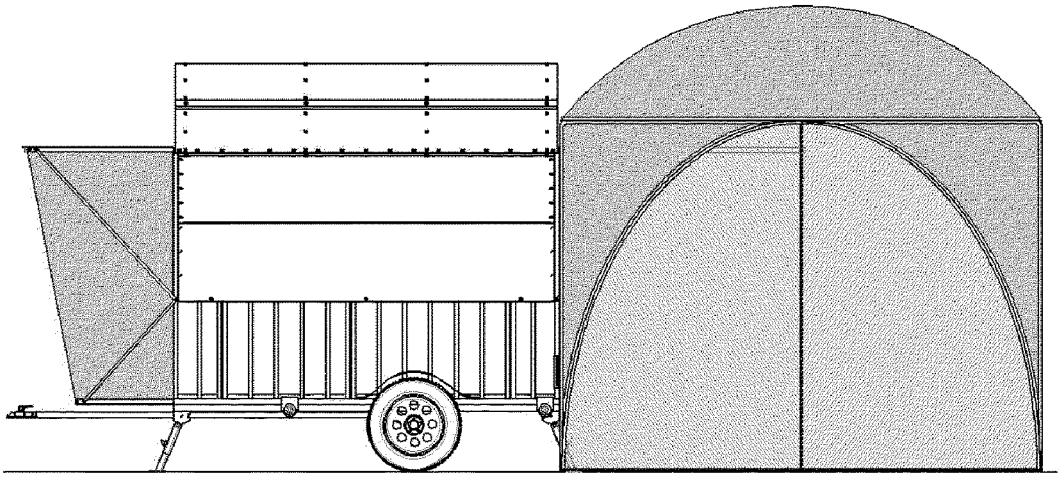
FIG. 33 is a perspective view of an alternative embodiment of the system of FIG. 30.
Figure 34:
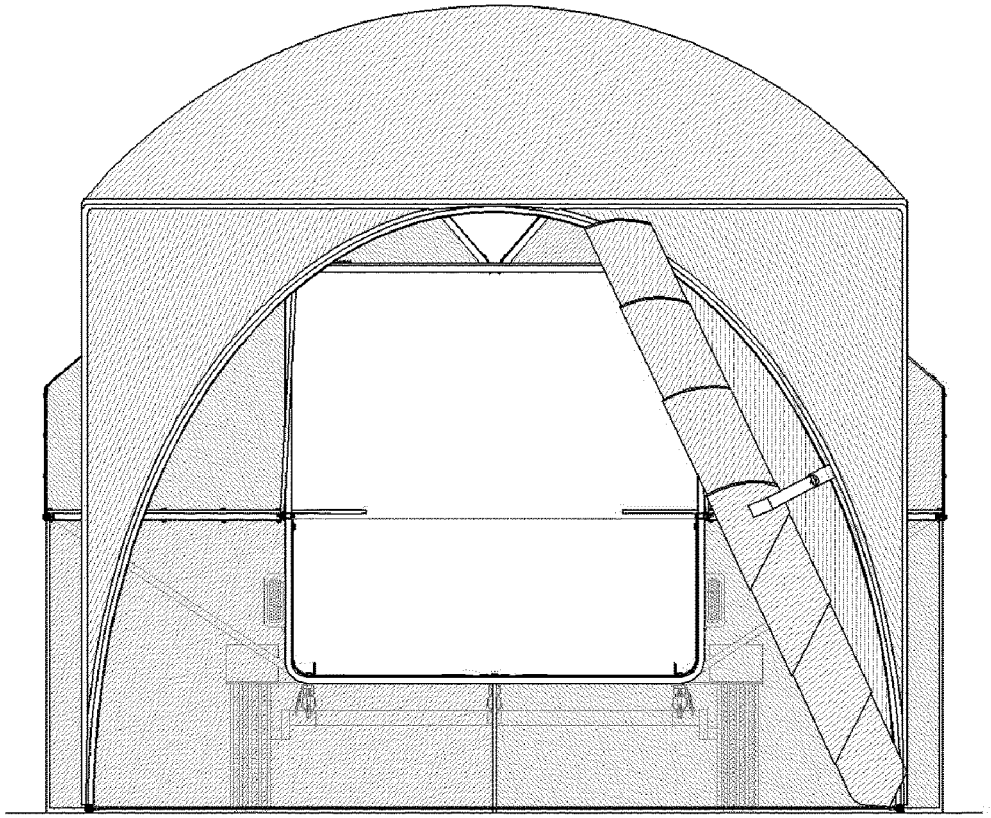
FIG. 34 is an end view of the system of FIG. 33.
Figure 35:
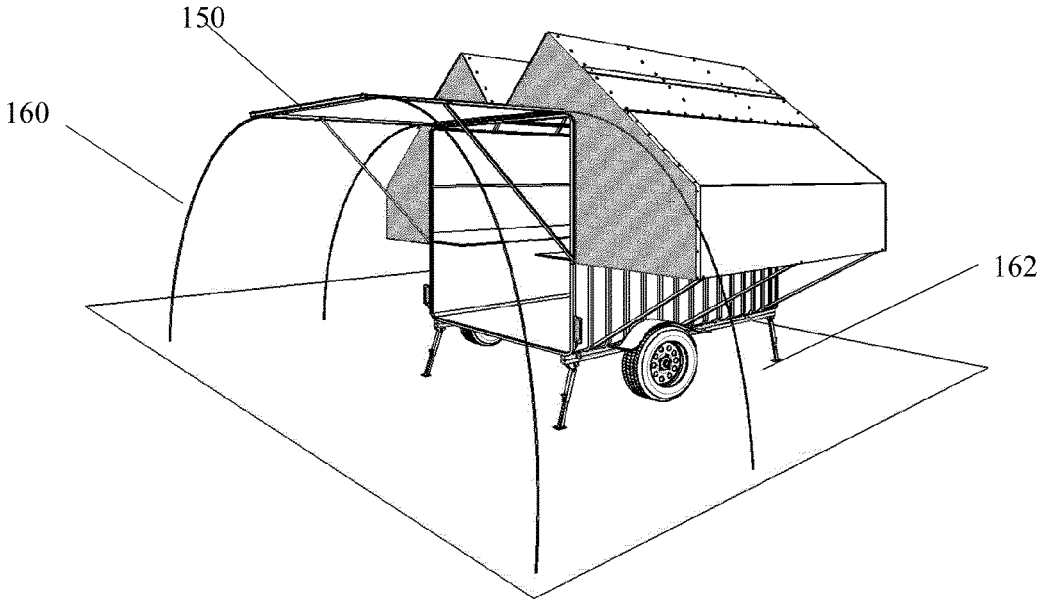
FIG. 35 is a perspective view of the FIG. 33 with a cover.
Figure 36:
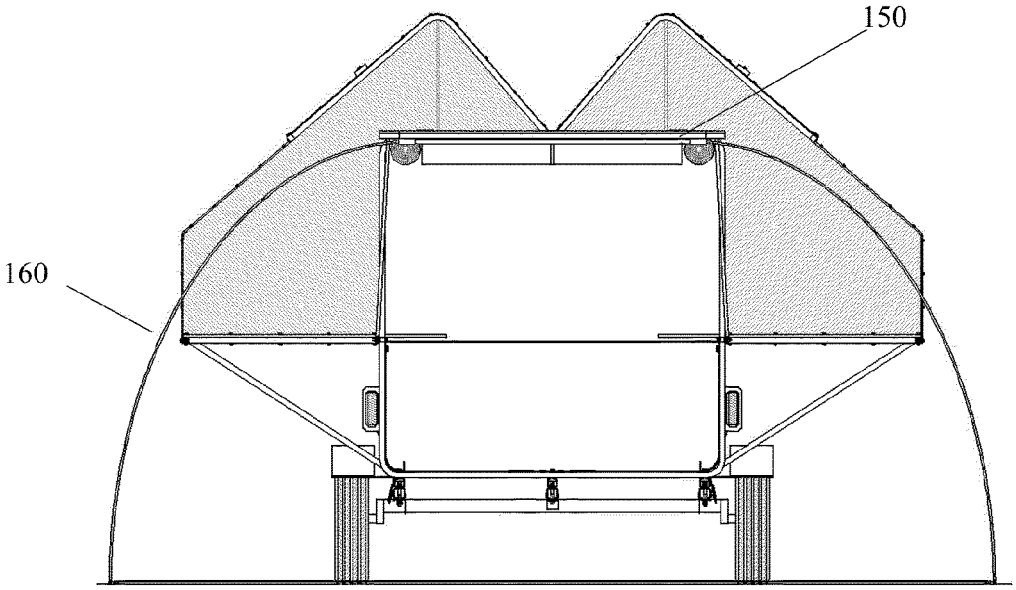
FIG. 36 is an end view of the system of FIG. 35.
Figure 37:
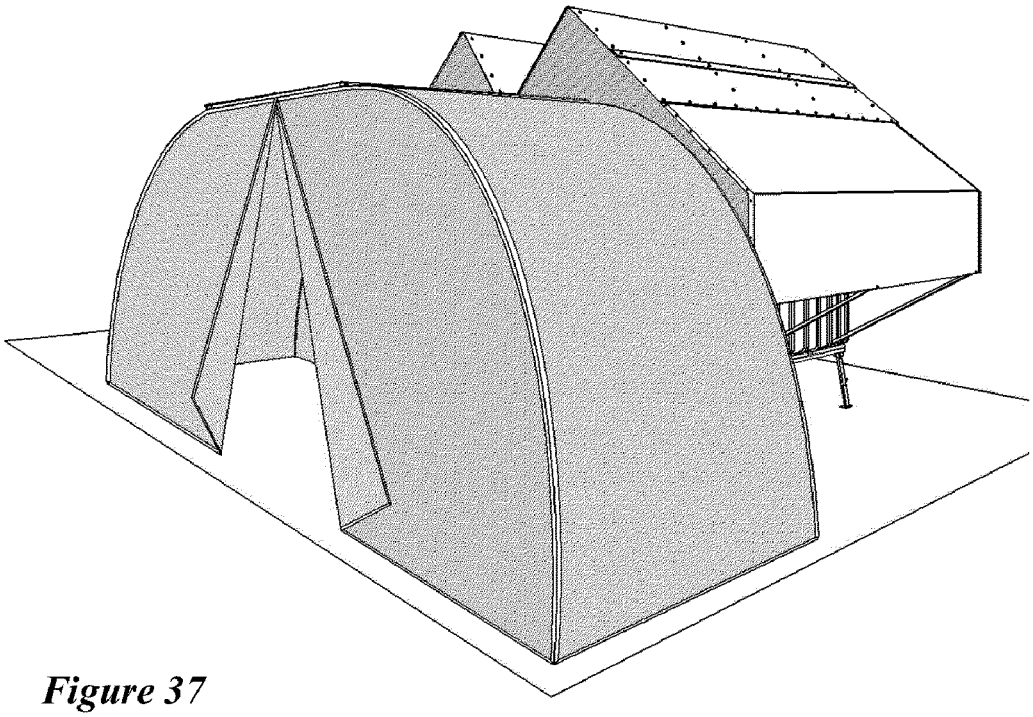
FIG. 37 is another perspective view of the embodiment of FIG. 35.
Figure 38:
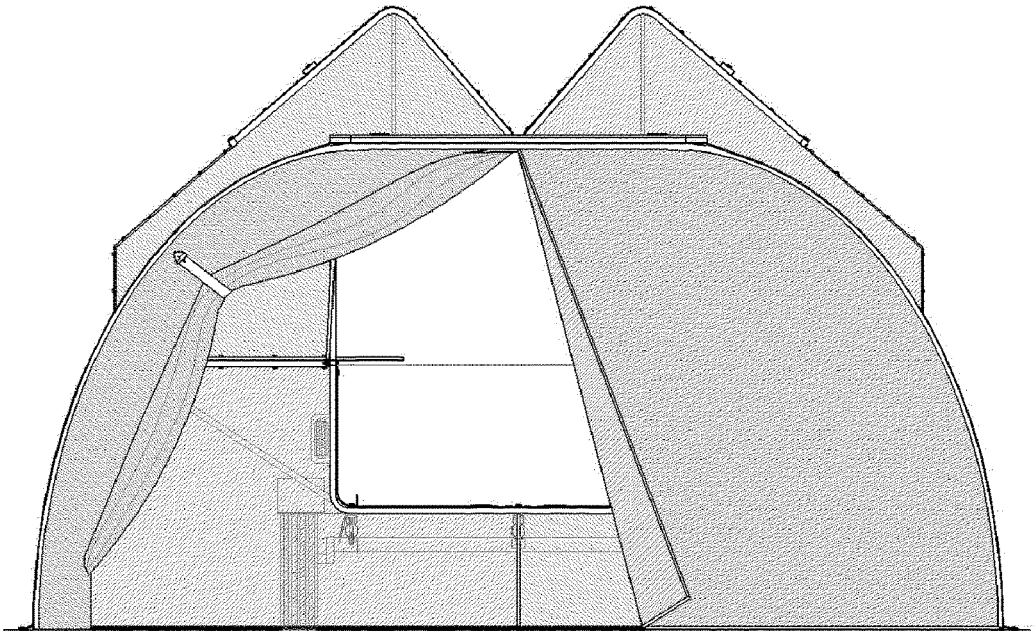
FIG. 38 is an end view of the embodiment of FIG. 37.

Another configuration of the preferred embodiment of the present invention is illustrated in FIGS. 31-32. This configuration enables a camping trailer to be greatly expanded. The camping trailer can be a hard shell camping trailer, a pop-up tent trailer or as shown in FIGS. 31-37*a* unique camping trailer as disclosed in application Ser. No. 10/904,282 filed on Nov. 2, 2004 and hereby incorporated herein by reference. This unique camping trailer includes a rear door 150 that swings upward and outward. The arch support members 20 are set up and secured as discussed above in a four-sided configuration. The ring member 40 and dome members 52, 54 are also secured onto the arch support members 20 as discussed above as shown in FIGS. 31-34. The tent material is then fastened over the arch support members and the dome members to form a shelter over the door 150 to allow communication into the tent trailer.

Another configuration uses a different approach as shown in FIGS. 35-38. This configuration uses elongated arch supports 160, 162 that engage with the upwardly extending door 150. These arch supports 160, 162 are secured to the door 150 that allows the door 150 to become part of the roof structure of the assembled tent structure.

It is to be expressly understood that the above embodiments are for explanatory purposes only and are not meant to limit the scope of the claimed inventions. Other embodiments of the present invention are considered within the scope of the claims.

What is claimed is:

1. A tent support system, wherein said tent support system includes:

a plurality of flexible base support members having upper, center and lower end portions;

lower fastening mechanisms securing said lower end portions on each of said base support members to the adjacent base support member;

an upper ring shaped support member;

upper fastening mechanisms securing said upper support member to said upper portion of each of said base support members;

flexible top support members that form a dome;

top fastening members securing said flexible top support members to either opposing sides of said upper support member or opposing said base support members and a flexible cover extending over said base support members and top support members.

2. The tent support system of claim 1 wherein said tent support system further includes:

each of said base support members is configured in the shape of an arch.

3. The tent support system of claim 1 wherein said tent support system further includes:

each of said base support members is configured in a geometrical shape.

4. The tent support system of claim 1 wherein said tent support system further includes:

each of said base support members include multiple sections.

5. The tent support system of claim 1 wherein said upper support member is:

a circular ring shaped member.

6. The tent support system of claim 1 wherein said upper support member includes:

multiple sections.

7. The tent support system of claim 1 wherein said top support members includes:

a plurality of dome supports that are secureable to either of said upper support member and said base support members.

8. The tent support system of claim 1 wherein said top support members includes:

a first dome support member with end sections secured to said tent support system at said center portion of opposing base support members; and a second dome support member with end sections secured to said tent support system at said center portion of opposing base support members.

9. The tent support system of claim 1 wherein said top support members include:

a first dome support member with end sections secured to said tent support system at said lower end potion of opposing base support members; and a second dome support member with end sections secured to said tent support system at said lower end portion of opposing base support members.

10. The tent support system of claim 1 wherein said top support members include:

a first dome support member with end sections secured to said tent support system at the center portion of opposing base support members; and a second dome support member with end sections secured to said tent support system at the center portion of said opposing base support members.

11. The tent support system of claim 1 wherein said top support members include:

a first dome support member with end sections secured to said tent support system at the center portion of opposing base support members:

a second dome support member with end sections secured to said tent support system at the center portion of said opposing base support members; and said first dome support member is adjustable relative to said second dome support member.

12. The tent support system of claim 1 wherein said upper support member is:

a substantially square shaped support member.

13. The tent support system of claim 1 wherein said upper support member is:

a substantially square shaped support member; and includes support members extending downward to support said substantially square shaped support member.

14. The tent support system of claim 1 wherein said lower fastening mechanisms includes:

a floor panel that secures said plurality of base support members to one another.

15. The tent support system of claim 1 wherein said plurality of base support members include:

four base support members to form a substantially square tent.

16. The tent support system of claim 1 wherein said plurality of base support members include:

three base support members to form a substantially three-sided tent.

17. The tent support system of claim 1 wherein said plurality of base support members include:

one of said plurality of base support members fastened to others of said plurality of base support members as a central support to create multiple tent systems secured to one another.

18. The tent support system of claim 1 wherein said tent support system further includes:

vestibules secured to at least one of said base support members.

19. The tent support system of claim 1 wherein tent support system further includes:

removable panels that are secured to said plurality of base support members.

20. The tent support system of claim 1 wherein said tent support system further includes:

roof panels that are attachable to said upper support member.

21. The tent support system of claim 1 wherein said tent support system further includes:

roof panels attached to said upper support member that are at least partially operable.

22. The tent support system of claim 1 wherein said tent support system further includes:

said plurality of base support members are securable in the cargo bed of a pickup truck.

23. The tent support system of claim 1 wherein said tent support system further includes:

said plurality of base support members are securable in the bed of a trailer.

24. The tent support system of claim 1 wherein said tent support system further includes:

said plurality of base support members are attachable to a trailer compartment.

25. The tent support system of claim 1 wherein said tent support system further includes:

said plurality of base support members are attachable to a vehicle compartment.

26. The tent support system of claim 1 wherein said tent support system further includes:

said plurality of base support members are mountable over a hot tub.

27. A support system for a temporary shelter, said support system comprises:

a plurality of flexible base support members each formed substantially in the shape of an arch;

a lower fastening mechanisms securing a lower end portion on each of said base support members to an adjacent base support member;

a ring shaped upper support member secured to each of said plurality of base support members;

a dome shaped flexible roof support attached to said upper support member; and a cover extending over said base support members and said roof support.

28. The support system of claim 27 wherein said roof support includes:

a roof support member that is movable to allow the roof of said temporary shelter to be partially openable.

29. The support system of claim 27 wherein said support system further includes:

Upper, center and lower portions on each of said plurality of base support members.

* * * * *